US007322199B2

(12) United States Patent
Kim

(10) Patent No.: US 7,322,199 B2
(45) Date of Patent: Jan. 29, 2008

(54) STIRLING COOLER

(75) Inventor: Sung Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 499 days.

(21) Appl. No.: 10/847,348

(22) Filed: May 18, 2004

(65) Prior Publication Data

US 2005/0166603 A1 Aug. 4, 2005

(30) Foreign Application Priority Data

Jan. 29, 2004 (KR) ..... 10-2004-0005676

(51) Int. Cl.
*F25B 9/00* (2006.01)

(52) U.S. Cl. ..... 62/6; 310/15

(58) Field of Classification Search ..... 62/6
See application file for complete search history.

(56) References Cited

U.S. PATENT DOCUMENTS 6,327,862 B1 * 12/2001 Hanes ..... 62/6
6,694,730 B2 * 2/2004 O'Baid et al. ..... 60/520
2005/0025565 A1 * 2/2005 Unger et al. ..... 403/373

* cited by examiner

*Primary Examiner*—Frantz Jules
*Assistant Examiner*—John Pettitt
(74) *Attorney, Agent, or Firm*—Greenblum & Bernstein, P.L.C.

(57) ABSTRACT

Disclosed is a Stirling cooler, in which a partition contacting a front surface of an inner stator is formed on a cylinder and a second stopper serving as a snap ring contacting a rear surface of the inner stator is detachably inserted into a ring-shaped groove of the cylinder, thus allowing the inner stator to be easily attached to and detached from the cylinder. Further, a protrusion inserted into a ring-shaped groove formed in the front surface of the inner stator is formed on the partition, and serves as an end ring of the inner stator, thus simplifying the assembly and disassembly of the inner stator.

17 Claims, 5 Drawing Sheets

STIRLING COOLER

BACKGROUND OF THE INVENTION

1. Field of the Invention

The present invention relates to a Stirling cooler, and more particularly to a Stirling cooler, in which an inner stator can be structurally attached and detached from a cylinder.

2. Description of the Related Art

Generally, a Stirling cooler is an external combustion engine using a reverse cycle of the Stirling cycle.

FIG. 1 is a cross-sectional view of a conventional Stirling cooler. FIG. 2 is an exploded perspective view of an essential part of the conventional Stirling cooler.

The conventional Stirling cooler comprises a case 4 provided with a cold tip 2 at an opened end thereof, a cylinder 6 fixedly installed in the case 4 and filled with a fluid, a piston 8 installed in the cylinder 6 such that the piston 8 can reciprocate and provided with a hollow 7 formed therein, a displacer 10 installed in the hollow 7 of the piston 8 such that the displacer 10 can reciprocate, a regenerator 12 longitudinally connected to the displacer 10, and provided with a cavity 1 positioned between the regenerator 12 and the cold tip 2 and filled with the fluid, and a heat exchanger 14 connected to the cylinder 6 and the regenerator 12.

The piston 8 is connected to a linear motor (M) installed between the case 4 and the cylinder 6, and reciprocates. The displacer 10 is connected to an elastic member 16 installed in the case 4 such that the displacer 10 faces the regenerator 12, thus being elastically supported such that the displacer 10 faces the cold tip 2. A hole 11 is formed in a lower part of the regenerator 12, opposite to the cold tip 2.

The linear motor (M) includes an outer stator 20 fixed to an inner surface of the case and connected to an external power source, an inner stator 30 positioned within the outer stator 20 and fixed to an outer surface of the cylinder 6, and a magnet 40 installed between the inner stator 30 and the outer stator 20 such that the magnet 40 can reciprocate in an axial direction of the cylinder 6 and be interworked with the piston 8.

The outer stator 20 includes a bobbin 22, a coil 24 wound on the bobbin 2 so that external power is applied to the coil 24, and a core 26 obtained by stacking a plurality of steel sheets along a circumferential direction of the bobbin 22 and surrounding the outer surface of the bobbin 22 wound with the coil 24.

The inner stator 30 includes a core 32 obtained by stacking a plurality of steel sheets along the circumferential direction of the bobbin 22, and a pair of end rings 34 and 36 respectively inserted into both ends of the core 32 for maintaining the shape of the core 32. The inner stator 30 is attached to an outer circumference of the cylinder 6 by an adhesive agent.

Hereinafter, operation of the above-described conventional Stirling cooler will be described in detail.

When power is applied to the coil 24 of the outer stator 20, an electromagnetic field is formed between the outer stator 20 and the inner stator 30, and the magnet 40 moves toward the cold tip 2 by means of the interaction of the electromagnetic field and the magnet 40.

Since the piston 8 is interworked with the magnet 40, the fluid of the cylinder 6 is isothermally compressed, is discharged from the heat exchanger 14 to emit heat, and is introduced into the regenerator 1 to emit sensible heat. Then, the fluid fills the cavity 1 between the regenerator 12 and the cold tip 2 and is isothermally expanded simultaneously. Here, as the fluid fills the cavity 1 between the regenerator 12 and the cold tip 2, the regenerator 12 and the displacer 10 move away from the cold tip 2.

Thereafter, when the direction of the power applied to the coil 24 of the outer stator 20 is changed, the magnet 40 together with the piston 8 moves away from the cold tip 2, and the displacer 10 and the regenerator 12 are returned to their earlier positions toward the cold tip 2 by the elastic force of the elastic member 16. The fluid filling the cavity 1 between the regenerator 12 and the cold tip 2 subsequently passes through the regenerator 12 and the heat exchanger 14 to absorb heat, and then re-fills the cylinder 6.

Since the cylinder 6 and the stator 30 must be supported by a jig while the inner stator 30 contacts the outer surface of the cylinder 6, and it is difficult to detach the inner stator 30 from the cylinder 6, the conventional Stirling cooler has a poor workability. Further, the fluid of the cylinder 6 chemically reacts with the adhesive agent applied between the cylinder 6 and the inner stator 30, thus causing contamination to the Stirling cooler.

SUMMARY OF THE INVENTION

Therefore, the present invention has been made in view of the above problems, and it is an object of the present invention to provide a Stirling cooler, in which an inner stator can be structurally attached to and detached from an outer surface of a cylinder.

In accordance with one aspect of the present invention, the above and other objects can be accomplished by the provision of a Stirling cooler comprising: a case; a cylinder fixedly installed in the case, and provided with a piston such that the piston can reciprocate therein; a displacer installed in the piston such that the displacer can reciprocate therein; a regenerator connected to the displacer in a line in an axial direction of the cylinder; an outer stator fixed between the case and the cylinder; an inner stator inserted into an outer surface of the cylinder; a magnet positioned between the outer stator and the inner stator for reciprocating the piston; and fixing device for fixing the inner stator such that the inner stator is attached to and detached from the cylinder.

Preferably, the fixing device may include: a stopper formed on an outer surface of the cylinder such that the stopper contacts a front surface of the inner stator in an installation direction of the inner stator; and a screw formed from the stopper toward the inner stator in an axial direction of the cylinder such that the screw is screwed into the inner stator.

Preferably, the screw may have a ring shape so that the screw is screwed with a ring-shaped groove formed in a front surface of the inner stator.

Further, preferably, the fixing device may include: a first stopper detachably attached to the cylinder such that the front stopper contacts one surface of the inner stator; and a second stopper formed integrally with the cylinder such that the second stopper contacts the other surface of the inner stator, and limit the movement of the inner stator in an axial direction.

Moreover, preferably, the first stopper may include a snap ring inserted into a ring-shaped groove formed on an outer surface of the cylinder.

Preferably, the second stopper may include a partition protruded perpendicularly from an outer surface of the cylinder in a radial direction. Preferably, the second stopper may further include a protrusion inserted into the inner stator in the axial direction.

Further, preferably, the protrusion may have a ring shape, and may be provided with a thread screwed with a thread formed on the ring-shaped groove of the inner stator.

In accordance with another aspect of the present invention, there is provided a Stirling cooler comprising: a case; a cylinder fixedly installed in the case, and provided with a piston such that the piston can reciprocate therein; a displacer installed in the piston such that the displacer can reciprocate therein; a regenerator connected to the displacer in a line in an axial direction of the cylinder; an outer stator fixed between the case and the cylinder; an inner stator inserted into an outer surface of the cylinder; a magnet positioned between the outer stator and the inner stator for reciprocating the piston; a snap ring detachably attached to the cylinder such that the snap ring contacts one surface of the inner stator; and a partition formed on an outer surface of the cylinder such that the partition contacts the other surface of the inner stator.

Preferably, a protrusion inserted into the inner stator in the axial direction may be formed from the partition. Further, preferably, the protrusion may have a ring shape, and be screwed into the inner stator.

In accordance with yet another aspect of the present invention, there is provided a Stirling cooler comprising: a case; a cylinder fixedly installed in the case, and provided with a piston such that the piston can reciprocate therein; a displacer installed in the piston such that the displacer can reciprocate therein; a regenerator connected to the displacer in a line in an axial direction of the cylinder; an outer stator fixed between the case and the cylinder; an inner stator inserted into an outer surface of the cylinder; a magnet positioned between the outer stator and the inner stator for reciprocating the piston; a snap ring detachably attached to the cylinder such that the snap ring contacts one surface of the inner stator; a partition formed on an outer surface of the cylinder such that the partition contacts the other surface of the inner stator; and an end ring formed from the partition and inserted into a ring-shaped groove formed in one surface of the inner stator.

Preferably, the end ring may be provided with a thread screwed with a thread formed on the ring-shaped groove of the inner stator.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, embodiments of the present invention will be described in detail with reference to the annexed drawings.

The present invention may comprise several embodiments, but preferred embodiments will be described hereinafter. In the following description of the present invention, a detailed description of known functions and configurations incorporated herein will be omitted when it may make the subject matter of the present invention rather unclear.

Figure 1:
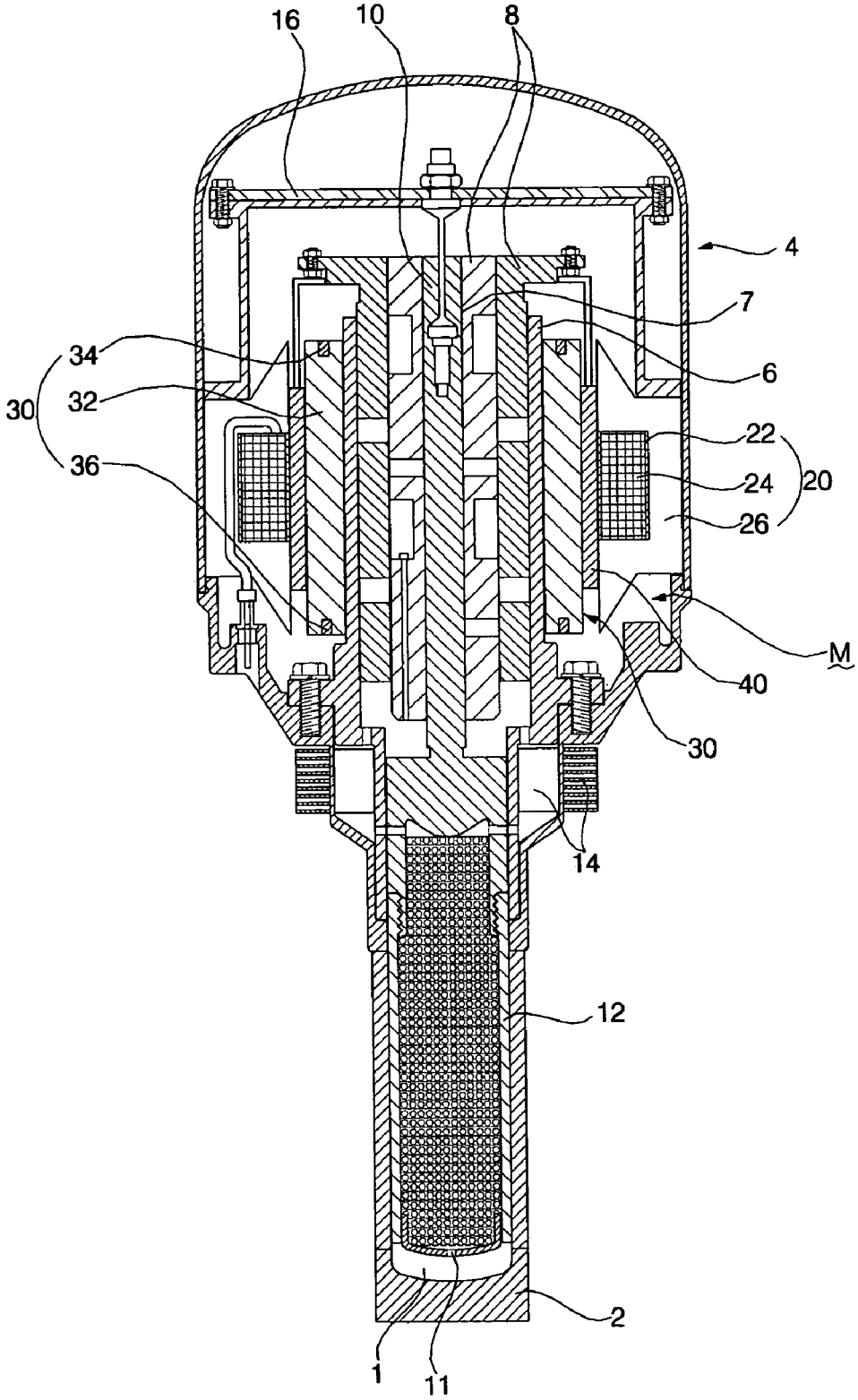
FIG. 1 (Prior Art)
FIG. 1 is a longitudinal-sectional view of a conventional Stirling cooler.
Figure 2:
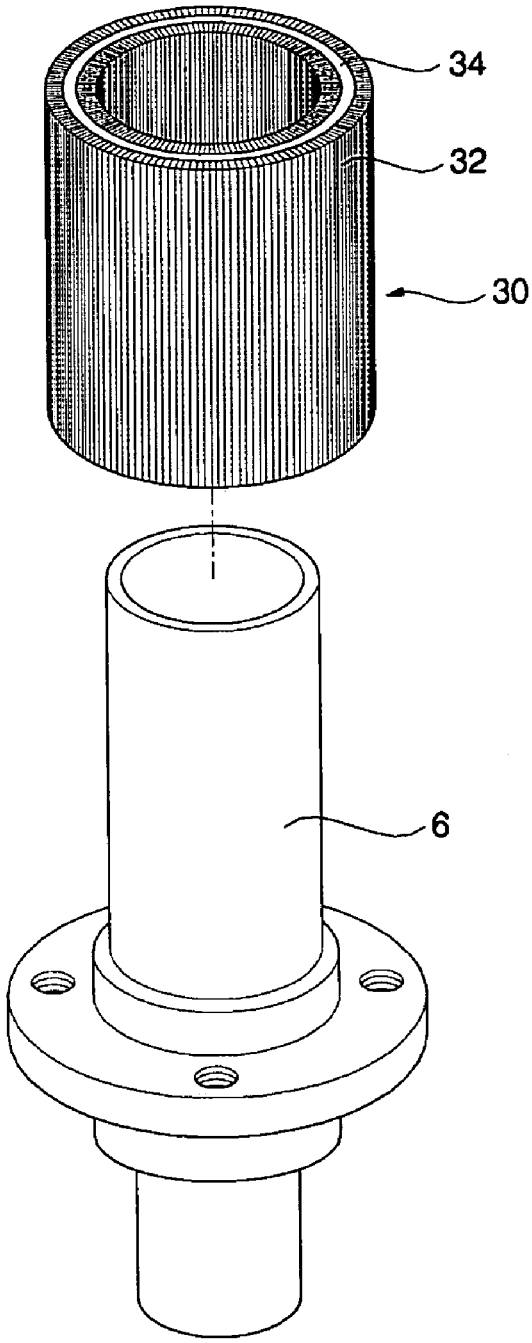
FIG. 2 (Prior Art)
FIG. 2 is an exploded perspective view of an essential part of the conventional Stirling cooler.
Figure 3:
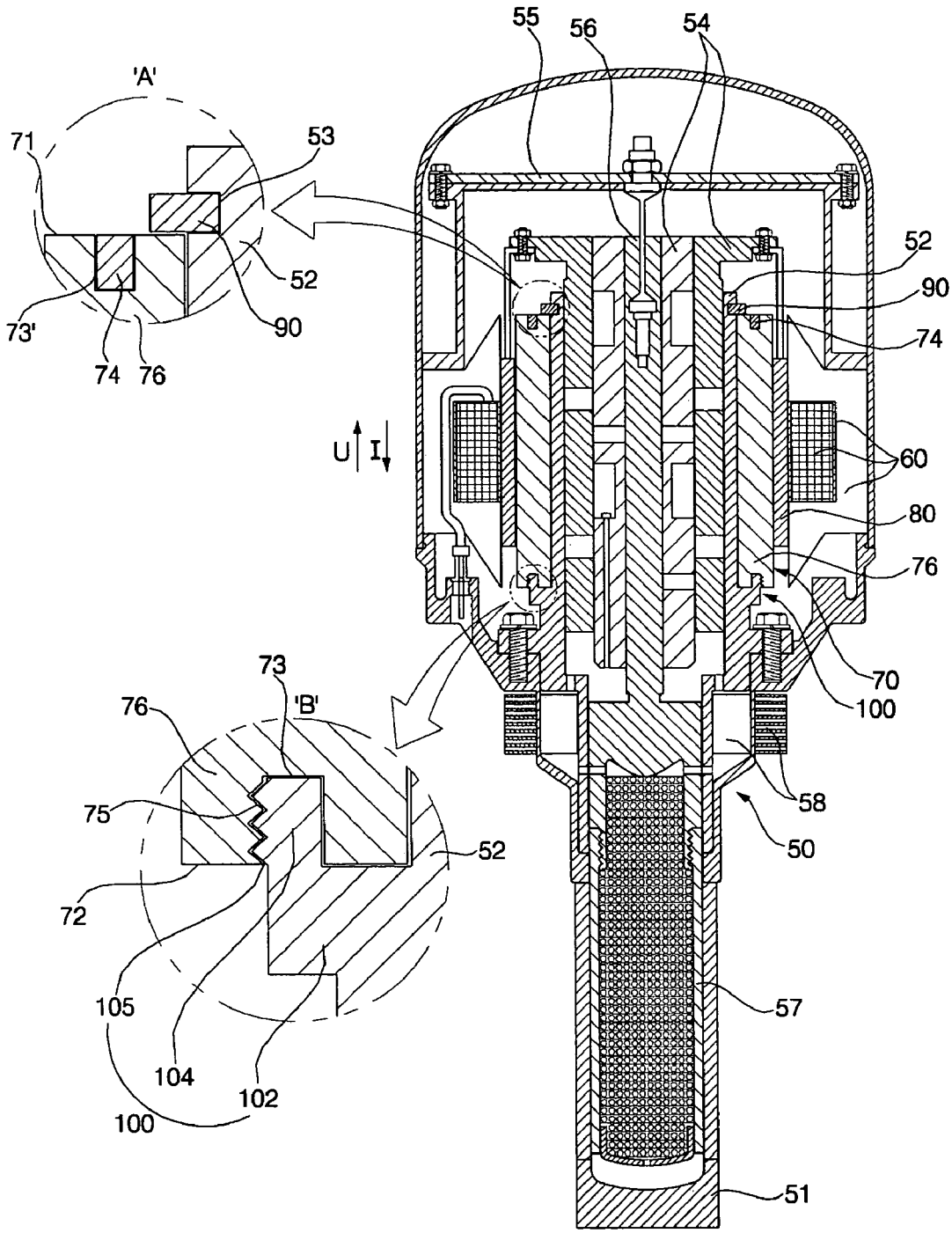
FIG. 3 is a longitudinal-sectional view of a Stirling cooler in accordance with a first embodiment of the present invention.
Figure 4:
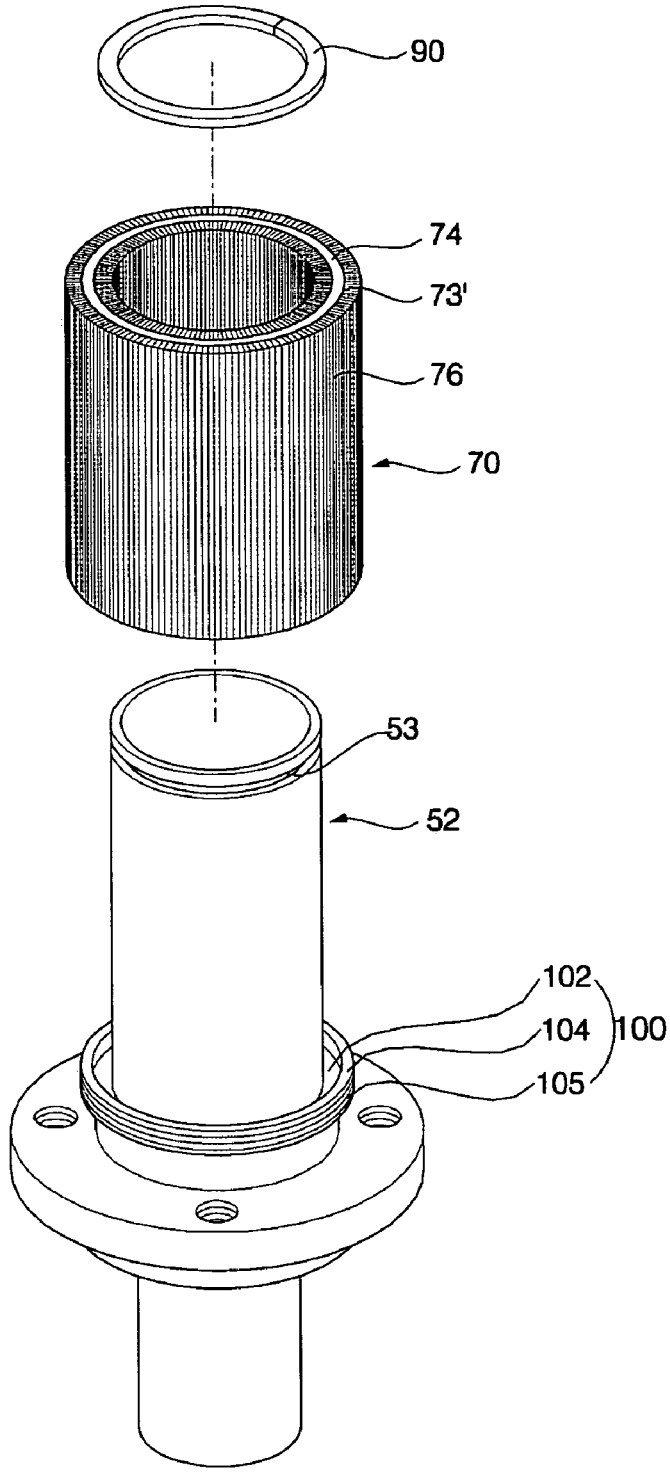
FIG. 4 is an exploded perspective view of an essential part of the Stirling cooler in accordance with the first embodiment of the present invention.

FIG. 3 is a longitudinal-sectional view of a Stirling cooler in accordance with a first embodiment of the present invention. FIG. 4 is an exploded perspective view of an essential part of the Stirling cooler in accordance with the first embodiment of the present invention.

The Stirling cooler of the present invention comprises a case 50 provided with a cold tip 51 at an opened end thereof, a cylinder 52, fixedly installed in the case 50, in which a piston 54 is installed so as to reciprocate therein, an outer stator 60 fixedly installed between the case 50 and the cylinder 52, an inner stator 70 inserted into an outer surface of the cylinder 52, a ring-shaped magnet 80 installed between the inner stator 70 and the outer stator 60 such that the magnet 80 can reciprocate in an axial direction of the cylinder 52, and fixing device for fixing the inner stator 60 so that the inner stator 60 can be attached to and detached from the cylinder 52.

A displacer 56 supported by an elastic member 55 installed on the case 50 is installed in the piston 54 such that the displacer 56 can reciprocate, a regenerator 57 is installed between the displacer 56 and the cold tip 51, and a heat exchanger 58 connected to the cylinder 52 and the regenerator 57 is installed at the inside and outside of the case 50.

The fixing device includes a first stopper 90 contacting a rear surface 71 of the inner stator 70 in a direction (an arrow I) such that the inner stator 70 is assembled with the cylinder 52, and a second stopper 100 contacting a front surface 72 of the inner stator 70, and limits the movement of the inner stator 70, installed at the outer surface of the cylinder 52, in an axial direction.

In order to disassemble the inner stator 70 from the cylinder 52 after the assembly, at least one of the first and second stoppers 90 and 100 must be detachably attached to the cylinder 52. In this embodiment, as shown in a portion 'A' of FIG. 3, the first stopper 90 is detachably attached to the cylinder 52 so as to allow the inner stator 70 to be assembled with and disassembled from the cylinder 52, and as shown in a portion 'B' of FIG. 3, the second stopper 100 is formed integrally with the cylinder 52.

The first stopper 90 is a snap ring, which is elastically inserted into a ring-shaped groove 53 formed in the outer surface of the cylinder 52, and limits the axial-directional movement of the inner stator in a direction (an arrow U) such that the inner stator 70 is disassembled from the cylinder 52. The first stopper 90 has an outer diameter greater than the inner diameter of the inner stator 70 and smaller than the outer diameter of the inner stator 70.

The second stopper 100 includes a partition 102 protruded perpendicularly from the outer surface of the cylinder 52 outward the radial direction. Thus, the partition 102 does not fall in the direction of the arrow I such that the inner stator 70 is assembled with the cylinder 52.

The partition 102 has a ring shape so as to firmly support the inner stator 70, and has an outer diameter smaller than the outer diameter of the inner stator 70.

The second stopper 100 further includes a protrusion 104 protruded perpendicularly from the partition 102 toward the inner stator 70 and inserted into the inner stator 70 in the axial direction. The protrusion 104 is protruded from an external terminal of the partition 102. Here, the protrusion 104 is positioned halfway between the inner diameter and the outer diameter of the inner stator 70 in the radial direction.

Particularly, the protrusion 104 has a ring shape, and a ring-shaped groove 73, into which the ring-shaped protrusion 104 is inserted, is formed in the front surface 72 of the inner stator 70. The inner stator 70 includes a core 76 having a cylindrical shape obtained by stacking a plurality of steel plates in a circumferential direction, ring-shaped grooves 73 and 73' respectively formed in the front and rear surfaces 72 and 71 of the inner stator 70, and end rings respectively inserted into the ring-shaped grooves 73 and 73' of the inner stator 70. Here, the protrusion 104 serves as the end ring inserted into the ring-shaped groove 73 formed in the front surface 72 of the inner stator. That is, when the inner stator 70 is assembled with the cylinder 52, the step of inserting the end ring into the front surface 72 of the inner stator 70 is simultaneously achieved.

An internal thread 105 and an external thread 75 are respectively formed on the protrusion 104 and the ring-shaped groove 73 formed in the front surface 72 of the inner stator 70, and are then screwed, thereby firmly assembling the inner stator 70 with the cylinder 52.

Here, the internal thread 105 of the protrusion 104 is formed on the outer surface of the protrusion 104 in the radial direction, and the external thread 75 of the inner stator 70 is formed on the outer surface of the ring-shaped groove formed in the front surface 72 of the inner stator in the radial direction.

Hereinafter, an assembly/disassembly process of the inner stator 70 of the Stirling cooler in accordance with the present invention will be described in detail.

First, a part of the inner stator 70 is assembled. That is, a plurality of the steel plates are stacked in a circumferential direction, and the end ring 74 is pushed into the ring-shaped groove 73' formed in the rear surface 71 of the inner stator 70 so as to maintain the shape of the inner stator 70.

When the above partially-assembled inner stator 70 is inserted into the outer surface of the cylinder 52 in the axial direction and the protrusion 104 is inserted into the ring-shaped groove 73 formed in the front surface 72 of the inner stator 70, the inner stator 70 is rotated centering on the cylinder 52 so that the front surface 72 of the inner stator 70 contacts the partition 102 so as to screw the protrusion 104 into the inner stator 70.

Then, the protrusion 104 serving as the end ring is inserted into the ring-shaped groove 73 formed in the front surface 72 of the inner stator 70. Thereby, the assembly of the inner stator 70 is completed, and the inner stator 70 no longer moves in the direction (the arrow I) such that the inner stator 70 is assembled with the cylinder 52.

When the first stopper 90 is inserted into the ring-shaped groove 53 of the cylinder 52 under this condition, the inner stator 70 no longer moves also in the direction (the arrow U) such that the inner stator 70 is disassembled from the cylinder 52, and the assembly of the inner stator 70 is completed.

When the inner stator 70 is disassembled from the cylinder 52, the first stopper 90 is pulled out of the ring-shaped groove 53 of the cylinder 52, the inner stator 70 is rotated in a direction such that the screw connection between the protrusion 104 and the inner stator 70 is released, and then the inner stator 70 is pulled out of the cylinder 52 in the axial direction.

As described above, in the Stirling cooler of the present invention, since the first stopper 90 serving as a snap ring contacting the rear surface 71 of the stator 70 is detachably inserted into the ring-shaped groove 53 of the cylinder 52, and the partition 102 contacting the front surface 72 of the inner stator 70 is formed on the cylinder 52, the inner stator 70 is easily assembled with and disassembled from the cylinder 52.

Further, the protrusion 104 inserted into the ring-shaped groove 73 formed in the front surface 72 of the inner stator 70 is formed on the partition 102, and serves as an end ring of the inner stator 70, thereby simplifying the assembly/disassembly of the inner stator 70.

Moreover, the inner stator 70 is structurally assembled into/disassembled from the cylinder 52, thereby eliminating the probability of contaminating a fluid in the cylinder 52.

Hereinafter, a Stirling cooler in accordance with a second embodiment of the present invention will be described. Some parts in this embodiment are substantially the same as those in the first embodiment and thus denoted by the same reference numerals even though they are depicted in different drawings. Further, a part of the construction and operation of the second embodiment are substantially the same as those of the first embodiment and a detailed description thereof will thus be omitted because it is considered to be unnecessary.

Figure 5:
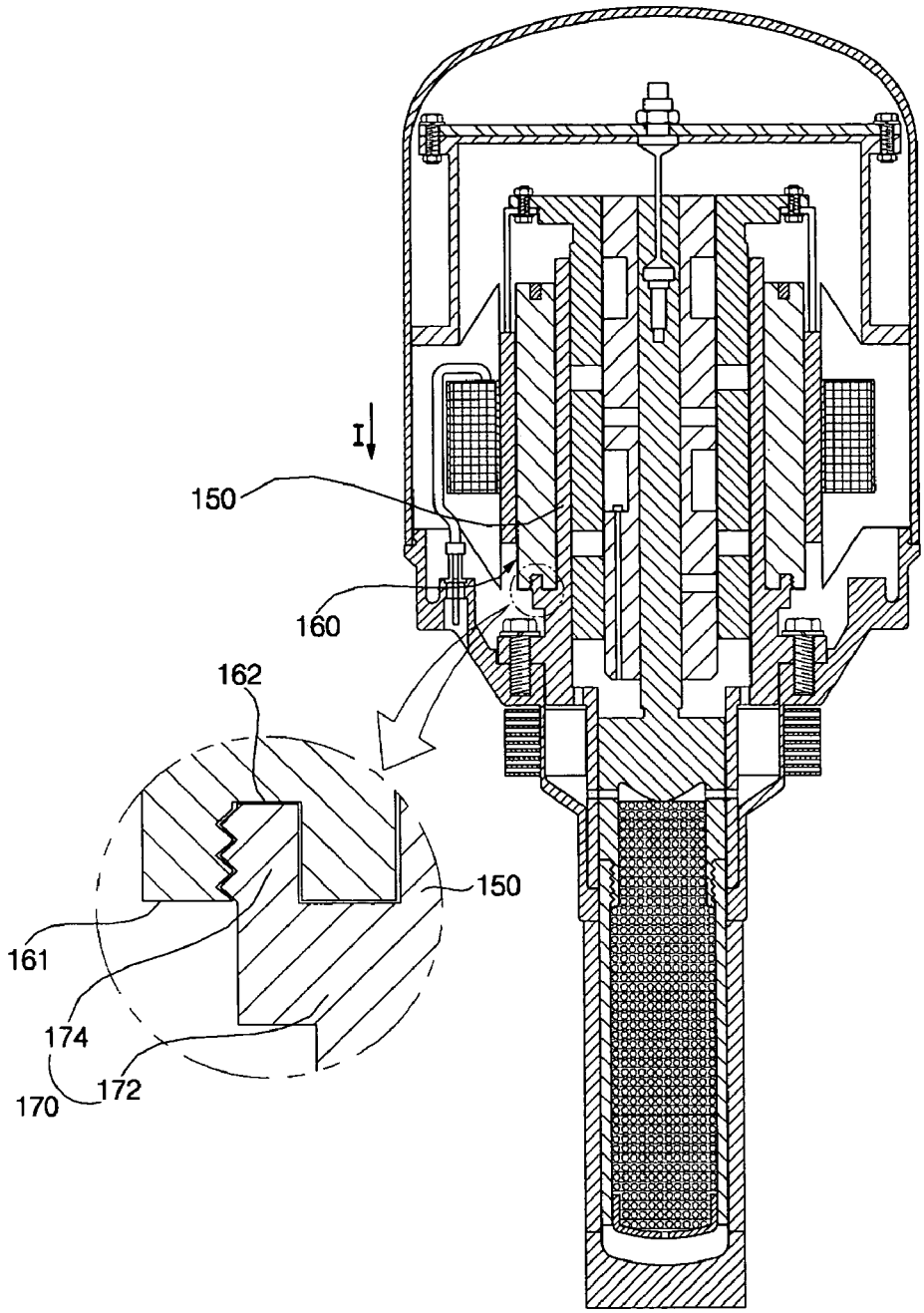
FIG. 5 is a longitudinal-sectional view of a Stirling cooler in accordance with a second embodiment of the present invention.

FIG. 5 is a longitudinal-sectional view of the Stirling cooler in accordance with the second embodiment of the present invention.

In the Stirling cooler in accordance with the second embodiment, an inner stator 160 is detachably fixed to an outer surface of a cylinder 150 by fixing device 170. The fixing device 170 includes a stopper 172 formed on an outer surface of the cylinder 150 such that the stopper 172 contacts a front surface 161 of the inner stator 160 in an installation direction (an arrow I) of the inner stator 160, and a screw 174 formed perpendicularly from the stopper 172 toward the inner stator 160 in an axial direction of the cylinder 150 such that the screw 174 is screwed into the inner stator 160.

The stopper 172 has a ring shape, and is protruded perpendicularly from the outer surface of the cylinder 150 in a radial direction. The screw 174 is formed integrally with the external terminal of the stopper 172.

The screw 174 has a ring shape corresponding to a ring-shaped groove 162 formed in the front surface 161 of the inner stator 160 so that the screw 174 serves as an end ring for maintaining the shape of the inner stator 160, and a thread is formed on the outer surface of the screw 174.

As described above, in the Stirling cooler in accordance with the second embodiment of the present invention, the inner stator 160 is easily attached to and detached from the outer surface of the cylinder 150, and the inner stator 160 is structurally installed at the cylinder 150, thereby preventing the fluid of the cylinder 150 from being contaminated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A Stirling cooler comprising:

a case;

a cylinder fixedly installed in the case, and provided with a piston such that the piston can reciprocate therein;

a displacer installed in the piston such that the displacer can reciprocate therein;

a regenerator connected to the displacer in a line in an axial direction of the cylinder;

an outer stator fixed between the case and the cylinder; an inner stator inserted into an outer surface of the cylinder;

a magnet positioned between the outer stator and the inner stator to reciprocate the piston; and a fixing device that fixes the inner stator to the cylinder, wherein the fixing device includes:

a first stopper detachably attached to the cylinder such that the first stopper contacts a rear surface of the inner stator; and a second stopper formed integrally with the cylinder such that the second stopper contacts a front surface of the inner stator, said second stopper having a protrusion outwardly protruding from the cylinder and inserted into a groove formed at the front surface of the inner stator, wherein a screw is formed at a side surface of the protrusion.

2. The Stirling cooler as set forth in claim 1, wherein the screw has a ring shape so that the screw is screwed with the groove formed at the front surface of the inner stator.

3. The Stirling cooler as set forth in claim 1, wherein the protrusion protrudes in an axial direction of the cylinder.

4. The Stirling cooler as set forth in claim 1, wherein the first stopper includes a snap ring inserted into a ring-shaped groove formed on an outer surface of the cylinder.

5. The Stirling cooler as set forth in claim 1, wherein the first stopper is disposed behind the second stopper in a direction such that the inner stator is inserted into the cylinder.

6. The Stirling cooler as set forth in claim 1, wherein:

end rings are respectively inserted in an axial direction into both ends of the inner stator; and one of the end rings is the protrusion.

7. The Stirling cooler as set forth in claim 1, wherein the second stopper includes a partition protruded perpendicularly from an outer surface of the cylinder in a radial direction.

8. The Stirling cooler as set forth in claim 7, wherein the partition has a ring shape.

9. The Stirling cooler as set forth in claim 1, wherein the protrusion has a ring shape.

10. The Stirling cooler as set forth in claim 7, wherein the protrusion is formed perpendicularly from an external end of the partition in the axial direction.

11. A Stirling cooler comprising:

a case;

a cylinder fixedly installed in the case, and provided with a piston such that the piston can reciprocate therein;

a displacer installed in the piston such that the displacer can reciprocate therein;

a regenerator connected to the displacer in a line in an axial direction of the cylinder;

an outer stator fixed between the case and the cylinder; an inner stator inserted into an outer surface of the cylinder;

a magnet positioned between the outer stator and the inner stator to reciprocate the piston; and a fixing device that fixes the inner stator to the cylinder, wherein the fixing device includes:

a first stopper detachably attached to the cylinder such that the first stopper contacts a rear surface of the inner stator; and a second stopper formed integrally with the cylinder such that the second stopper contacts a front surface of the inner stator, said second stopper having a protrusion outwardly protruding from the cylinder and inserted into a groove formed at the front surface of the inner stator, and wherein the protrusion is provided with a thread screwed with a thread formed on the groove of the inner stator.

12. The Stirling cooler as set forth in claim 11, wherein a thread is formed on an outer surface of the protrusion in a radial direction.

13. A Stirling cooler comprising:

a case;

a cylinder fixedly installed in the case, and provided with a piston such that the piston reciprocates therein;

a displacer installed in the piston such that the displacer reciprocates therein;

a regenerator connected to the displacer in a line in an axial direction of the cylinder;

an outer stator fixed between the case and the cylinder;

an inner stator inserted into an outer surface of the cylinder;

a magnet positioned between the outer stator and the inner stator to reciprocate the piston; and a partition formed on an outer surface of the cylinder such that the partition contacts a front surface of the inner stator, said partition provided with a protrusion having a thread thereon screwed into the inner stator.

14. The Stirling cooler as set forth in claim 13, wherein the protrusion is inserted into the inner stator in the axial direction is formed on the partition.

15. The Stirling cooler as set forth in claim 14, wherein the protrusion has a ring shape.

16. The Stirling cooler as set forth in claim 14, wherein a snap ring detachably attached to the cylinder such that the snap ring contacts a rear surface of the inner stator.

17. A Stirling cooler comprising:

a case;

a cylinder fixedly installed in the case, and provided with a piston such that the piston reciprocates therein;

a displacer installed in the piston such that the displacer reciprocates therein;

a regenerator connected to the displacer in a line in an axial direction of the cylinder;

an outer stator fixed between the case and the cylinder;

an inner stator inserted into an outer surface of the cylinder;

a magnet positioned between the outer stator and the inner stator to reciprocate the piston;

a snap ring detachably attached to the cylinder such that the snap ring contacts one surface of the inner stator;

a partition formed on an outer surface of the cylinder such that the partition contacts another surface of the inner stator; and an end ring formed on the partition and inserted into a ring-shaped groove formed in one surface of the inner stator, wherein the end ring is provided with a thread screwed with a thread formed on the ring-shaped groove of the inner stator.

* * * * *